US005862575A

United States Patent [19]

Zolin

[11] Patent Number: 5,862,575

[45] Date of Patent: Jan. 26, 1999

[54] ON-LINE HYDROENHANCEMENT EVALUATION TECHNIQUE

[75] Inventor: Paul F. Zolin, Kennebunk, Me.

[73] Assignee: Valmet, Inc., Biddeford, Me.

[21] Appl. No.: 922,412

[22] Filed: Sep. 3, 1997

[51] Int. Cl.[6] ..... D06B 1/02

[52] U.S. Cl. ..... 28/167; 28/104; 26/1; 73/159

[58] Field of Search ..... 73/159; 26/38, 26/1; 28/104, 103, 105, 106, 165, 167; 8/147

[56] References Cited

U.S. PATENT DOCUMENTS

| | | | |
|---|---|---|---|
| 3,056,281 | 10/1962 | Smyth | 73/38 |
| 3,371,518 | 3/1968 | Keyes | 73/38 |
| 4,130,689 | 12/1978 | Costa, Jr. | 428/398 |
| 4,132,592 | 1/1979 | Brandon et al. | 162/216 |
| 4,166,877 | 9/1979 | Brandon et al. | 428/221 |
| 4,174,237 | 11/1979 | Hemming, Jr. et al. | 156/64 |
| 4,499,691 | 2/1985 | Greenway | 28/104 |
| 4,676,091 | 6/1987 | Schuster et al. | 73/38 |
| 4,892,621 | 1/1990 | Eskelinen | 73/38 |
| 4,960,630 | 10/1990 | Greenway et al. | 428/131 |
| 4,995,151 | 2/1991 | Siegel et al. | 26/69 |
| 5,136,761 | 8/1992 | Sternlieb et al. | 28/104 |
| 5,142,752 | 9/1992 | Greenway et al. | 28/105 |
| 5,311,389 | 5/1994 | Howey | 360/133 |
| 5,412,976 | 5/1995 | Vogt | 73/38 |
| 5,630,261 | 5/1997 | Beasley, Jr. | 28/104 |
| 5,657,520 | 8/1997 | Greenway et al. | 28/104 |

FOREIGN PATENT DOCUMENTS

| | | | |
|---|---|---|---|
| 8909850 | 10/1989 | European Pat. Off. | 28/104 |

*Primary Examiner*—Michael A. Neas
*Assistant Examiner*—Larry P. Worrell, Jr
*Attorney, Agent, or Firm*—Joseph W. Molasky & Associates

[57] ABSTRACT

A technique and apparatus for evaluating the degree of hydroenhancement achieved in a woven fabric. The degree of hydroenhancement is related to the permeability of the woven fabric (i.e., the permeability of the woven fabric will decrease as the hydroenhancement increases). The hydroenhanced fabric is pulled over a vacuum source (while a constant vacuum is maintained) and the air flow through the fabric is measured. The air flow per unit area of fabric is then calculated and defined as the permeability. Alternatively, the permeability can be calculated by maintaining a constant air flow and measuring the vacuum drop associated with the treated fabric. The degree of hydroenhancement may then be assessed as related to this permeability measurement. The measurement may be performed on "wet" fabric immediately after it exits the hydroenhancement process and the permeability measurements used as a control signal for the hydroenhancement process (that is, to regulate the machinery used to impart the hydroenhanced quality to the fabric). Alternatively, the measurement may be performed on "dry" fabric and used, as an audit process, to assess the quality of the finished product.

28 Claims, 3 Drawing Sheets

ON-LINE HYDROENHANCEMENT EVALUATION TECHNIQUE

BACKGROUND OF THE INVENTION

1. Field of the Invention

The present invention relates to an on-line hydroenhancement evaluation technique and, more particularly, to a technique for measuring the permeability of a woven fabric (i.e., textile) being subjected to a hydroenhancement process.

2. Description of the Prior Art

In conventional hydroentangling processes, webs of non-woven fibers are treated with high pressure fluids while supported on an "entangling" substrate wire. Typically, the substrate wire is provided on a drum or continuous planar conveyor which traverses a series of pressurized fluid jets to entangle the web into cohesive ordered fiber groups and configurations corresponding to open areas in the screen. Entanglement is effected by action of the fluid jets which cause fibers in the web to migrate to open areas in the screen, tangle and intertwine.

Hydroenhancement is a term used to describe the hydroentanglement process when used specifically on a woven fabric. In hydroenhancement, the properties of a woven fabric are modified (or "enhanced") by exposing the fabric to a sequence of high pressure water jets to act on the woven, spun thread fibers that make up the fabric. During the enhancement process, fibers from the same or adjacent threads become entangled, decreasing the open spaces among the weft and warp threads.

The above-described loss of openness in the woven fabric during the hydroenhancement process results in a reduction of permeability of the fabric, where permeability is defined as the air that will flow through a unit area of a fabric at a known, controlled pressure drop. The capability of measuring the permeability of a fabric during the hydroenhancement process ("wet" permeability) would be a useful control tool in order to provide an indication of the degree of enhancement for a given fabric, allowing the process to be altered to increase or decrease the degree of hydroenhancement, as required. The capability of measuring the permeability of a fabric at the end of the drying process ("dry" permeability) would be useful as a means of auditing the quality of the finished product, in terms of both the product itself and the efficiency of the machinery used to produced the fabric.

SUMMARY OF THE INVENTION

The present invention relates to an on-line hydroenhancement evaluation technique and, more particularly, to a technique for measuring the permeability of a fabric being subjected to a hydroenhancement process.

In a preferred embodiment of the present invention, a fabric is first subjected to any type of suitable hydroenhancement process. Subsequent to the hydroenhancement, the fabric is monitored using the inventive permeability test to evaluate the degree of hydroenhancement that has been achieved. In particular, the fabric passes over a vacuum region using a vacuum roll, a moving wire system, or an uncovered, smooth polished vacuum slot, for example. A vacuum controller is used to maintain a constant vacuum in the measurement zone (under the woven fabric). A flow measuring device measures the air flow through the fabric and then calculates the air flow per unit area (i.e., "permeability"). The resultant permeability measurement can then be used as a feedback signal to the hydroenhancement process. In an exemplary arrangement, an additional extraction slot may be included in the test apparatus and located prior to the vacuum slot. The extraction slot is used to ensure that all surface water remaining on the fabric after the hydroenhancement process is removed prior to measuring the permeability of the fabric. Alternatively, the control system can be designed to calculate the permeability by maintaining a constant air flow and measuring the vacuum pressure drop attributed the degree of hydroenhancement imparted to the processed fabric.

In one embodiment, the vacuum controller may comprise a vacuum roll, vacuum source, control valve and flow meter. The vacuum roll contains a "permeability" slot and the vacuum at the permeability slot is maintained at a constant value by using the valve. The permeability is calculated by measuring the air flow through the slot (or alternatively, measuring the vacuum drop during a constant air flow). When used as part of a "dry" permeability test, the measured signal is used as a measure of hydroenhancement of the finished product. When used as part of a "wet" permeability test, the permeability measurement signal may be used in a dynamic mode as a feedback signal to control (either automatically or by manual operator adjustment) the hydroenhancement jet energy imparted to the fabric under process, the line speed of the hydroenhancement process, or both. The "wet" permeability test result can also be used as a "static" measure of the hydroenhancement process.

It is an advantage of the evaluation technique of the present invention that the capability of measuring and recording the permeability of a processed fabric provides statistical process control. As a result, the quality of the hydroenhanced product line is significantly improved by understanding the interrelationship of the variables (line speed and hydroenhancement energy, for example) associated with the process, and the product yield can be increased by curtailing over-enhancement. Additionally, recording the machine operations is useful for archival purposes Various and other aspects of the present invention will become apparent during the course of the following discussion and by reference to the accompanying drawings.

BRIEF DESCRIPTION OF THE DRAWINGS

Referring now to the drawings.

DETAILED DESCRIPTION OF THE PREFERRED EMBODIMENT

Figure 1:
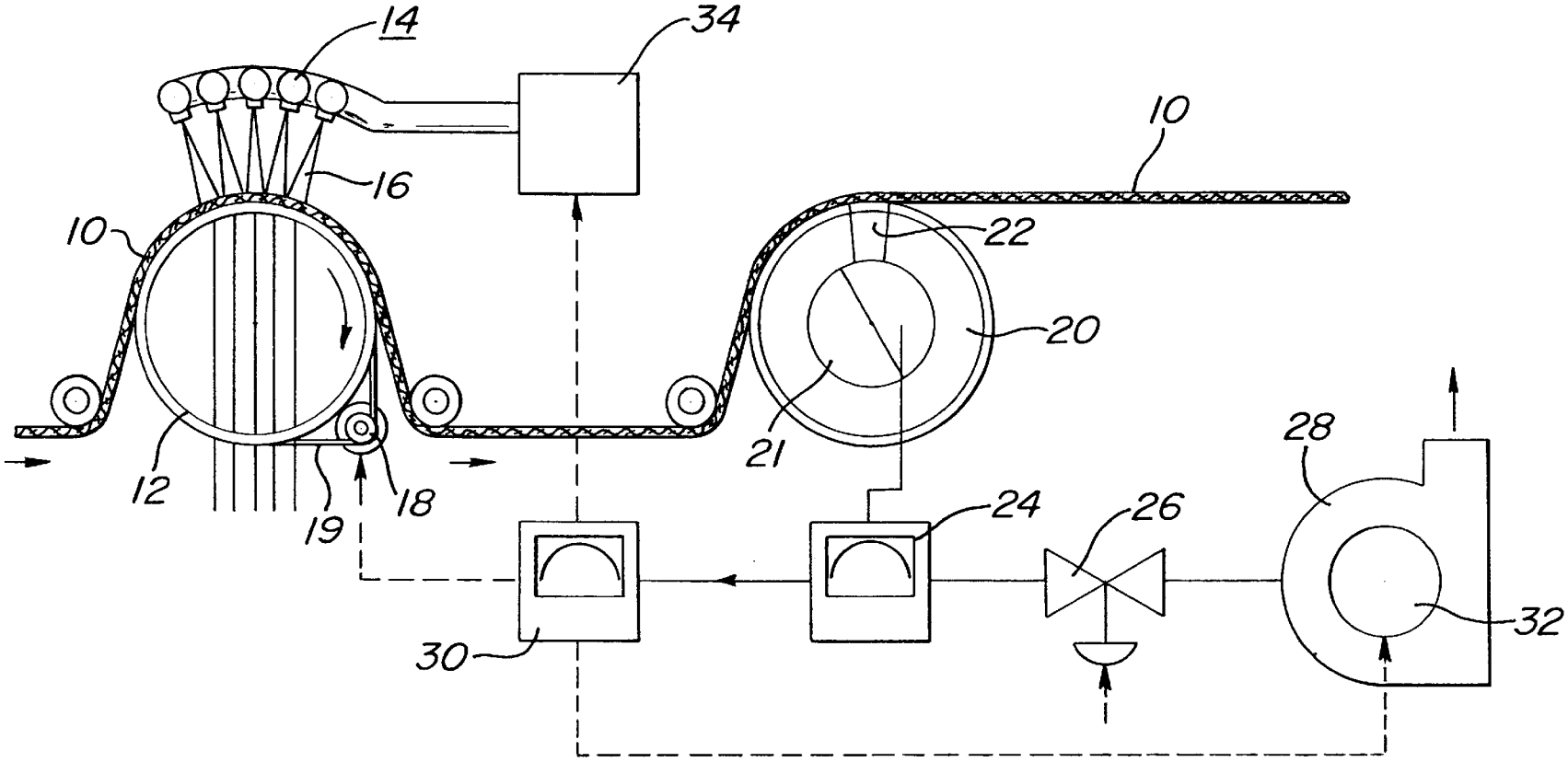
FIG. 1 illustrates an exemplary vacuum roll hydroenhancement process incorporating the on-line hydroenhancement evaluation technique of the present invention useful for measuring the "wet" permeability of a fabric.

During the course of the following discussion, different fabrication processes for forming hydroenhanced woven fabric will be discussed. It is to be understood that the discussion of any such process is exemplary only, and that the on-line measurement technique of the present invention is useful in conjunction with any arrangement capable of performing hydroenhancement on a woven fabric. Additionally, "permeability" may be defined as either the air flow through a unit area of fabric at a constant pressure, or the vacuum drop through a unit area of fabric subjected to a constant air flow. The various embodiments of the present invention may be easily configured to either maintain constant air flow and measure the pressure drop, or maintain a constant vacuum and measure the air flow. The following discussion associated with FIGS. 1–4 describe an illustrative embodiment that utilizes a constant vacuum and measures the air flow through the fabric and should be considered as exemplary only. Referring now to FIG. 1, a woven fabric 10 first passes through an exemplary hydroenhancement process utilizing a vacuum roll 12 for supporting fabric 10, with a plurality of pressurized jets 14 positioned above fabric 10 as it passes over roll 12. The plurality of pressurized water streams 16 exiting jets 14 pass through fabric 10, as indicated, entangling adjacent threads and thereby decreasing the open spaces between the chute and warp threads, where this decrease is defined as "hydroenhancement". As is well known, there are various factors that relate to the degree of hydroenhancement achieved. These factors include the number of jets used in the process, the pressure of the water exiting the jets (referred to as the "energy" imparted to the fabric), and the speed of the fabric through the process. In the exemplary embodiment as shown in FIG. 1, the line speed is controlled by a drive motor 18 attached to a drive belt 19, where drive belt 19 is disposed to surround the drum portion of vacuum roll 12. Drive motor 18 is configured to rotate vacuum roll 12 in a clockwise manner, as indicated by the arrow in FIG. 1, where the speed of drive motor 18 (and hence the speed of drive belt 19) controls the line speed of the hydroenhancement process. In accordance with the on-line permeability measurement technique of the present invention, various ones of these factors may be controlled so as to achieve any desired degree of hydroenhancement.

The arrangement of FIG. 1 is particularly suited for measuring the "wet" permeability of fabric 10. That is, the permeability is measured in a continuous fashion, immediately after the completion of the hydroenhancement process. As shown, fabric 10 passes over a second vacuum roll 20, including a vacuum slot 22. Vacuum roll 20 may also include an extraction slot 21, disposed prior to vacuum slot 22, where extraction slot 21 functions to remove any standing water remaining on the surface of fabric 10, thus ensuring a repeatable permeability reading. Coupled to vacuum slot 22 is a flow meter 24, a vacuum control valve 26 and a vacuum source 28. A vacuum controller device 30 is shown as coupled to flow meter 24. Controller 30 functions to maintain a constant vacuum in slot 22 by, for example, throttling valve 26, as indicated by the dotted line connection between controller 30 and valve 26. Alternatively, controller 30 may utilize a variable speed motor 32 associated with vacuum source 28 to control the vacuum at slot 22 (again indicated by the dotted line in FIG. 1). Flow meter 24 functions to measure the air flow through fabric 10 at vacuum slot 22 and provide the measured air flow value as an input signal to controller 30. Controller 30 subsequently uses this air flow measurement, in conjunction with known parameters (e.g., size of vacuum slot opening) to calculate the air flow per unit area of fabric 10. The "air flow per unit area of fabric", under constant vacuum, is defined as the "permeability" of the fabric. As mentioned above, the arrangement of FIG. 1 may be reconfigured to maintain a constant air flow through slot 22 and measure the vacuum drop at slot 22 to calculate the permeability.

In this particular "wet" permeability measurement arrangement of the present invention, the "permeability output" from controller 30 can be used in at least two ways. First, the output can be used by an operator overseeing the process line as a means of quality control. Indeed, if an operator determines that the permeability calculation is either too high or too low, the operator may modify the hydroenhancement process to change one of the processing variables (e.g., line speed, number of jets, water pressure from jets, etc.) until a proper permeability output is generated by controller 30. Alternatively, the output from controller 30 may be used as a feedback signal to automatically control the hydroenhancement process. As indicated by the dotted lines in FIG. 1, the output from controller 30 may be coupled to either drive motor 18 controlling the hydroenhancement line or jet controller 34, or both. Jet controller 34 may function in a variety of modes, including but not limited to, turning "off" and "on" jets in sequence in response to the feedback signal, increasing or decreasing the water pressure associated with the jets, or, indeed, simultaneously controlling both the number of active jets and the water pressure (that is, controlling in any acceptable manner the energy imparted to the fabric). As mentioned above, the control of the jet process may be used either alone or in combination with the line speed to achieve the desired permeability reading.

Figures 2, 4:
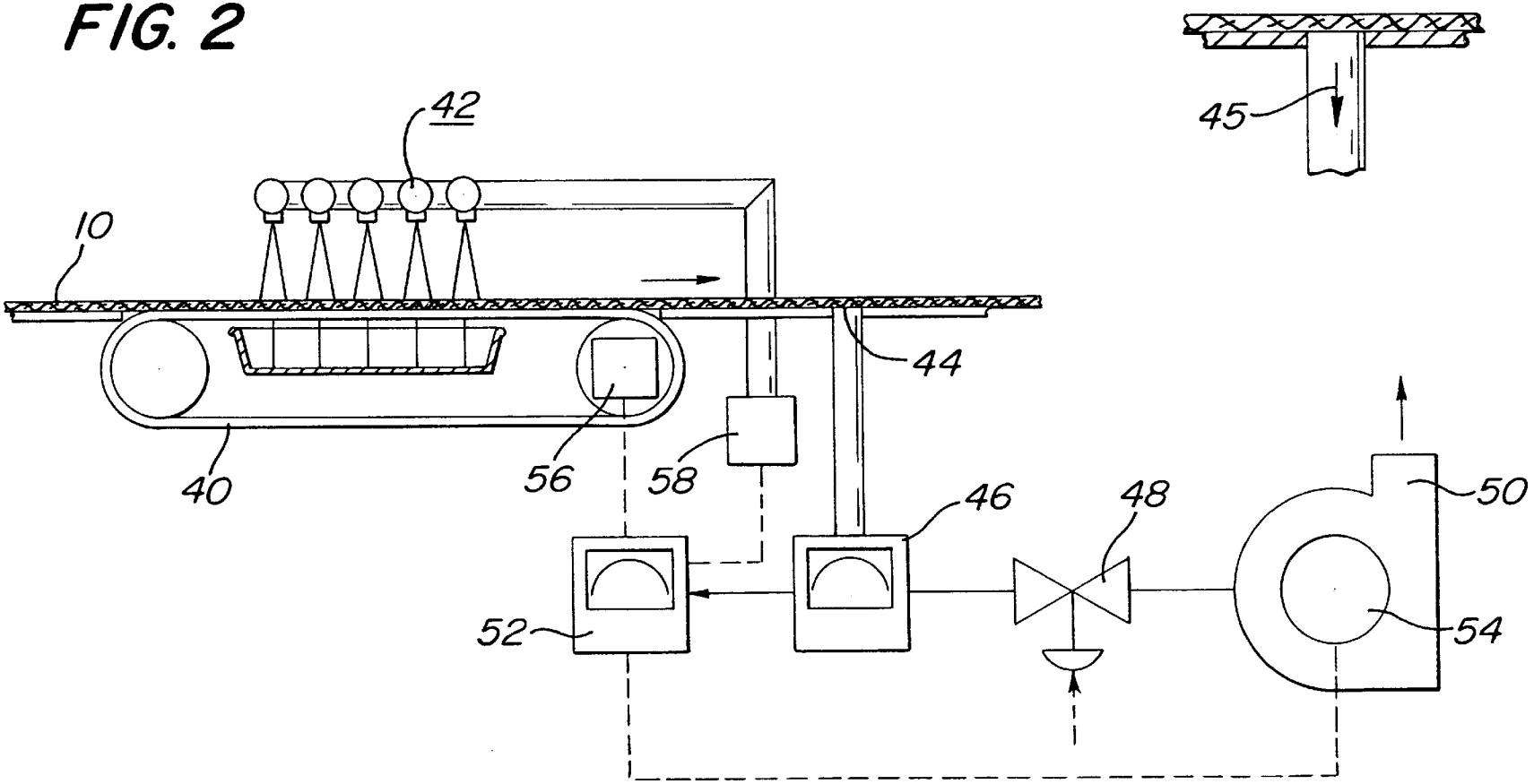
FIG. 2 illustrates an exemplary vacuum box hydroenhancement process incorporating the on-line hydroenhancement evaluation technique of the present invention useful for measuring the "wet" permeability of a fabric.
FIG. 4 contains an enlarged view of a portion of an alternative covered or uncovered vacuum slot useful for measuring fabric permeability.

An alternative embodiment of a "wet" permeability measurement arrangement of the present invention is illustrated in FIG. 2. In this embodiment, hydroenhancement is achieved using a moving wire process. Fabric 10 passes in a straight line along a conveyor belt 40. A plurality of pressurized jets 42 are positioned above belt 40 and used to impart the desired hydroenhanced quality to fabric 10. After exiting the hydroenhancement process, fabric 10 enters the on-line hydroenhancement measurement arrangement of the present invention and, in particular, passes over a vacuum slot 44 located under a wire support substrate 40. An alternative vacuum slot arrangement is illustrated in an enlarged view in FIG. 4. The arrangement illustrated in FIG. 4 utilizes a vacuum slot 45, similar to slot 44, but without the need for the overlying wire support structure for fabric 10. As is known, certain fabrics have sufficient internal strength such that a wire substrate is not required. In these instances, a covered or an uncovered, smooth and polished vacuum slot 45 may be used interchangeably with slot 44 in the permeability testing apparatus as illustrated in detail in FIG. 2. In general, a vacuum slot may be covered with a screen, a set of perforations, or, as mentioned above, left uncovered.

Referring back to FIG. 2, vacuum slot 44 (or, alternatively slot 45 as depicted in FIG. 4) is directly coupled to a series arrangement of a flow meter 46, a vacuum control valve 48 and a vacuum source 50. Also directly coupled to flow meter 46 is a vacuum control device 52. As with the arrangement described above, controller 52 is used to maintain a constant vacuum at slot 44, either by controlling valve 48 or vacuum source 50 (where a variable speed motor 54 is used to drive vacuum source 50 and is responsive to control signals from controller 52). Similar to the arrangement described above in associated with FIG. 1, flow meter 46 measures the air flow through fabric 10 at vacuum slot 44 and provides this measurement as an input signal to controller 52. The permeability of fabric 10 may then be calculated by controller 52, where permeability is defined as the air flow per unit area. The calculated permeability can then either be used by a process operator to manually control the line (or merely recorded), or used as a feedback signal to control the hydroenhancement process, as discussed above. Illustrated in FIG. 2 are exemplary feedback signal lines between controller 52 and line speed controller 56 and jet controller 58. Thus, the permeability measurement signal may be used to change the line speed, jet pressure, or number of active jets so as to achieve the desired permeability measurement.

Figure 3:
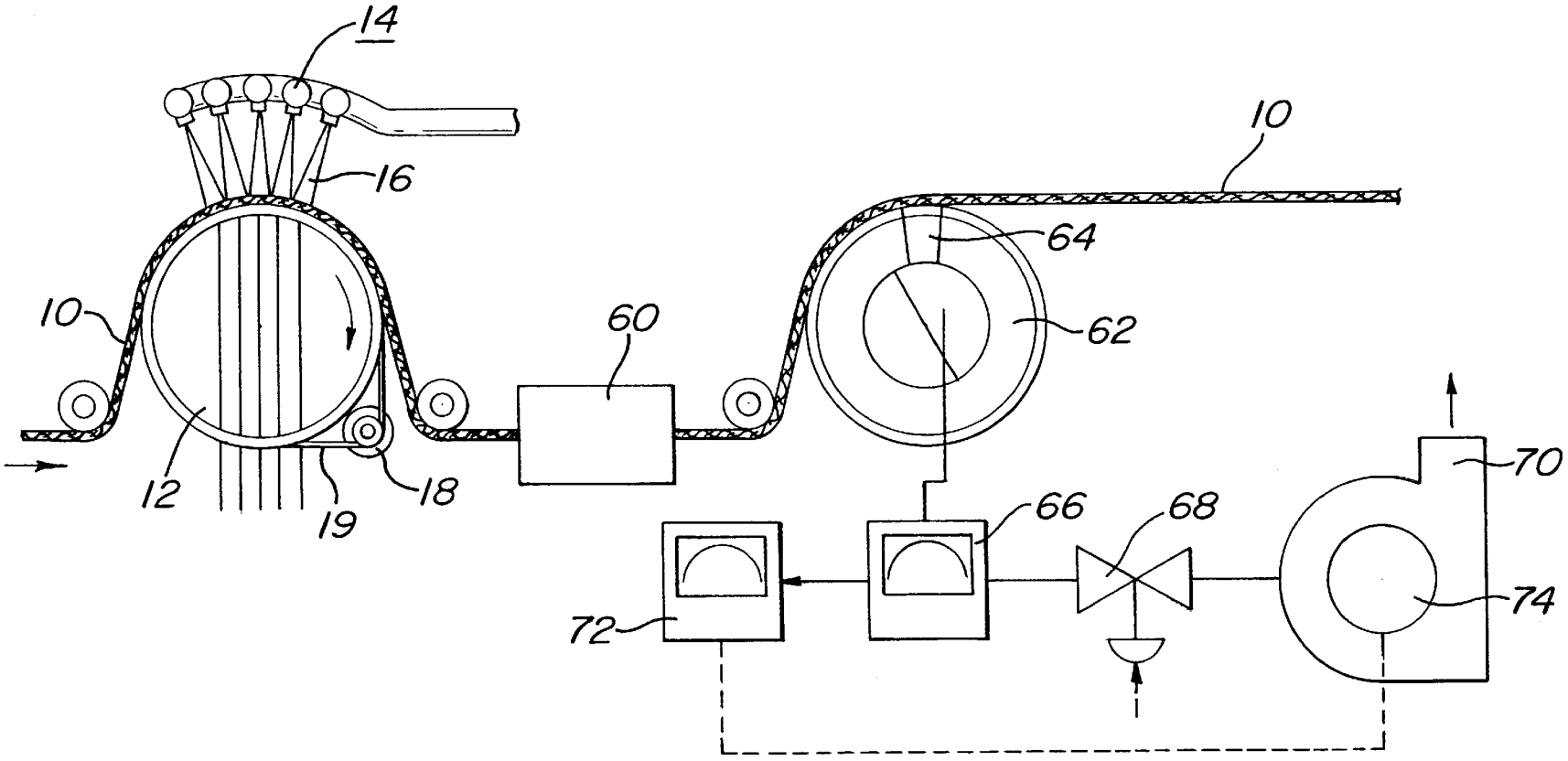
FIG. 3 illustrates an exemplary "dry" permeability testing arrangement for evaluating the hydroenhancement of a finished fabric.

As mentioned above, the on-line hydroenhancement measurement technique of the present invention may also be utilized to perform a "dry" permeability measurement at the end of the drying process. In general, the measurement of the permeability after the fabric has been dried, in conjunction with the line speed and various process algorithms, may be used to audit the product quality, machine efficiency, as well as used in calculating the actual product rate and various other performance measurements. Referring to FIG. 3, fabric 10 is subjected to an exemplary hydroenhancement process, in this case, the process as discussed above in association with FIG. 1. Fabric 10 is then "dried", as indicated by element 60 in FIG. 3. For the purposes of the present invention, the various processes utilized to dry fabric 10 are of no concern. At the end of the drying process, a "dry" permeability measurement is performed. For the exemplary embodiment of FIG. 3, a vacuum roll is used to perform this measurement. It is to be understood that any suitable vacuum slot arrangement may also be utilized (for example, the moving wire configuration as illustrated in FIG. 2, or the uncovered vacuum slot as shown in detail in FIG. 4). As shown, fabric 10 passes over a vacuum roll 62 which includes a vacuum slot 64. A flow meter 66, vacuum control valve 68 and vacuum source 70 are coupled in series with vacuum slot 64. A vacuum controller 72 is also coupled to vacuum slot 64. As with the embodiments described above, controller 72 functions to maintain a constant vacuum in slot 64 by controlling either valve 68 or vacuum source 70 (using a variable speed motor 74, for example, to control vacuum source 70). Flow meter 66 is used to measure the actual air flow through fabric 10 as it passes over vacuum slot 64 and provides the air flow measurement as an input signal to controller 72. As discussed above, controller 72 then uses this measured value to calculate the air flow per unit area of fabric, thus providing a measurement of the "dry" permeability of fabric 10. The dry permeability reading may be used as part of an overall quality process as indicating an acceptable measure of hydroenhancement in the finished product. Alternatively, the "dry" permeability measurement and resulting hydroenhancement assessment may be used to modify any of the various parameters associated with the hydroenhancement process.

It is to be understood that the above-described method of assessing the hydroenhancement of a woven fabric may include various modifications not discussed above and fall within the spirit and scope of the present invention. For example, although various hydroenhancement processes have been discussed, they are exemplary only, and the permeability testing as described above and defined by the claims recited hereinbelow may be used in conjunction with any suitable hydroenhancement process. Additionally, as discussed above, the permeability measurement may be performed either by measuring the air flow through a unit area of fabric under constant pressure or, by measuring the vacuum drop associated with a constant air flow through a unit area of fabric. Either measurement technique will result in providing a permeability calculation that defines the degree of hydroenhancement imparted to the fabric being processed.

What is claimed is:

1. A method of dynamically controlling the degree of hydroenhancement imparted into a woven fabric by measuring air flow through a unit area of woven fabric at a known, controlled pressure drop and defining said measurement as a permeability of said woven fabric, the method comprising the steps of:

a) providing a hydroenhanced woven fabric;

b) passing the hydroenhanced woven fabric over a vacuum slot;

c) providing an air flow through said hydroenhanced woven fabric at said vacuum slot; and d) calculating the permeability of said fabric as a function of both vacuum and air flow, wherein the permeability of said woven fabric is inversely proportional to the degree of hydroenhancement;

e) adjusting a hydroenhancement process in response to the calculated permeability; and f) re-processing the hydroenhanced woven fabric provided in step a) through the hydroenhancement process adjusted in step e) until the predetermined degree of hydroenhancement is achieved.

2. The method as defined in claim 1 wherein in performing step b), maintaining the vacuum at the vacuum slot at a constant value and in performing step d), measuring the air flow through said fabric at a constant vacuum.

3. The method as defined in claim 1 wherein in performing step c), maintaining the air flow at a constant value and in performing step d), measuring the vacuum drop through said fabric at a constant air flow.

4. The method as defined in claim 1 wherein in performing step b), passing the hydroenhanced woven fabric over a vacuum roll and a vacuum slot is included in the vacuum roll.

5. The method as defined in claim 1 wherein in performing step b), passing the hydroenhanced woven fabric over a moving wire assembly and the vacuum slot is included in the moving wire assembly.

6. The method as defined in claim 1 wherein in performing step b), passing the hydroenhanced woven fabric over a vacuum slot without a wire.

7. The method as defined in claim 1 wherein steps b) through d) are performed immediately after the hydroenhancement process such that the fabric is still wet when the permeability is calculated, the hydroenhancement process including the steps of:

i) exposing a woven fabric to a plurality of pressurized streams of water from a series of jets, the number of jets and the water pressure defining the hydroenhancement energy; and ii) moving said woven fabric under the plurality of pressurized streams of water at a predetermined line speed.

8. The method as defined in claim 7 wherein the wet permeability measurement calculated in step d) is used as a feedback control signal for the associated hydroenhancement process.

9. The method as defined in claim 8 wherein the hydroenhancement energy is controlled.

10. The method as defined in claim 9 wherein the number of active jets used to perform hydroenhancement is controlled.

11. The method as defined in claim 9 wherein the water pressure associated with the jets is controlled.

12. The method as defined in claim 8 wherein the hydroenhancement line speed is controlled.

13. The method as defined in claim 8 wherein both the hydroenhancement energy and line speed are controlled.

14. The method as defined in claim 1 wherein in performing step d), measuring the "dry" permeability.

15. Apparatus for measuring the degree of hydroenhancement of a wove fabric, the apparatus comprising;

vacuum means disposed to allow a hydroenhanced woven fabric to pass thereover;

a flow meter coupled to said vacuum means to measure air flow through said vacuum means; and controller means coupled to said flow meter and used to provide control signals to the hydroenhancement process, said controller means responsive to the air flow through said fabric and the vacuum at said vacuum slot for calculating air flow through a unit area of said woven fabric at a known, controlled pressure drop, defined as a permeability of said hydroenhanced fabric, wherein the permeability is inversely proportional to the degree of hydroenhancement in the woven fabric, the control signals for adjusting parameters associated with the hydroenhancement process to modify the degree of hydroenhancement imparted to the woven fabric.

16. The apparatus as defined in claim 15 wherein the apparatus is used to measure the "wet" permeability of the hydroenhanced fabric, the apparatus further comprising an extraction slot for removing surface water from said hydroenhanced fabric prior to the fabric passing over the vacuum means.

17. The apparatus as defined in claim 16 for use with hydroenhancement process equipment including a plurality of pressurized water jets and means for moving the woven fabric underneath said plurality of pressurized water jets, wherein the controller means further provides as separate outputs hydroenhancement process control signals to the hydroenhancement process equipment.

18. The apparatus as defined in claim 17 wherein the controller means provides a process control signal to the plurality of pressurized water jets.

19. The apparatus as defined in claim 18 wherein the process control signal is used to control the number of active jets in the plurality of jets.

20. The apparatus as defined in claim 18 wherein the process control signal is used to control the water pressure associated with the plurality of pressurized jets.

21. The apparatus as defined in claim 17 wherein the controller means provides a process control output signal to the moving means so as to control the line speed of said moving means.

22. The apparatus as defined in claim 17 wherein the controller means provides process control signals to both the plurality of pressurized jets and the moving means.

23. The apparatus as defined in claim 17 wherein the controller means provides a process control signal to indicate the completion of the enhancement process for inventory record purposes.

24. The apparatus as defined in claim 23 wherein the completion process control signal includes the final permeability level of the hydroenhanced fabric.

25. The apparatus as defined in claim 15 wherein the apparatus is used to measure the "dry" permeability of the hydroenhanced fabric at the end of the fabrication process.

26. The apparatus as defined in claim 15 wherein the vacuum means comprises a vacuum slot included in a vacuum roll.

27. The apparatus as defined in claim 15 wherein the vacuum means comprises a vacuum slot included in a moving wire machine.

28. The apparatus as defined in claim 15 wherein the vacuum means comprises a smooth vacuum slot with a moving wire.

* * * * *